US006467174B1

(12) United States Patent
Kotori

(10) Patent No.: US 6,467,174 B1
(45) Date of Patent: Oct. 22, 2002

(54) COMBINATION SCORING AND MARKING APPARATUS FOR SHEET GOODS AND METHODS OF USE

(76) Inventor: Fatmir Kotori, 22 Wilcox St., Rochester, NY (US) 14607

( * ) Notice: Subject to any disclaimer, the term of this patent is extended or adjusted under 35 U.S.C. 154(b) by 0 days.

(21) Appl. No.: 09/860,848

(22) Filed: May 18, 2001

(51) Int. Cl.[7] ..... B26B 29/06
(52) U.S. Cl. ..... 30/293; 83/745
(58) Field of Search ..... 30/293, 294, 287; 83/745

(56) References Cited

U.S. PATENT DOCUMENTS 5,048,189 A 9/1991 Aurness et al.
5,050,306 A 9/1991 Renaud
5,083,375 A 1/1992 Helm, Sr.
5,197,195 A * 3/1993 Aikens ..... 30/293
5,231,764 A * 8/1993 Chang ..... 30/293
5,265,342 A 11/1993 Lang, Jr.
5,471,753 A * 12/1995 Rodrigues ..... 30/293
D406,537 S 3/1999 Sharp

OTHER PUBLICATIONS

Trend–Lines Catalog, Feb. 1998, p. 27.

* cited by examiner

*Primary Examiner*—Douglas D. Watts
(74) *Attorney, Agent, or Firm*—Greenwald & Basch LLP; Duane C. Basch

(57) ABSTRACT

The present invention is a method and apparatus for scoring and marking sheet goods, particularly drywall or plasterboard. The apparatus is used in conjunction with a conventional T-square and consists of a clamp for locking the apparatus at a fixed position along the T-square blade and a scoring mechanism such as a utility-knife blade for scoring the sheet as the T-square slides along a straight edge thereof. The apparatus further includes a marking mechanism, aligned with the scoring mechanism so as to allow a user to optionally mark the sheet rather than scoring it.

16 Claims, 6 Drawing Sheets

COMBINATION SCORING AND MARKING APPARATUS FOR SHEET GOODS AND METHODS OF USE

This invention relates generally to a construction tool and more particularly to an improved scoring and marking apparatus for a drywall or plasterboard sheet and similar sheet goods.

BACKGROUND AND SUMMARY OF THE INVENTION

Numerous wallboard tools are known for use in wall construction employing prefabricated materials, such as gypsum plaster encased in paper or compressed wood fibers and chips, which are a substitute for plaster and wood panels. Heretofore, a number of patents and publications have disclosed tools for marking and cutting sheet goods such as drywall, the relevant portions of which are hereby incorporated by reference and may be briefly summarized as follows:

U.S. Pat. No. 5,048,189 to Aurness et al., issued Sep. 17, 1991 and U.S. Pat. No. 5,083,375 to Helm, Sr., issued Jan. 28, 1992, each disclose a drywall or wallboard cutter requiring a dedicated unit for adjusting and moving the cutter relative to the edge of a sheet.

U.S. Pat. No. 5,231,764 to Chang, issued Aug. 3, 1993, teaches a cutter for plasterboard sheet that may be affixed to a T-square. The cutter surrounds the elongated rule of the T-square and is retained thereon by a set screen impinging on the face of the elongated rule.

In a "Trendlines" catalog, February 1998, p. 27, there is depicted a drywall scoring square.

In accordance with the present invention, there is provided a scoring apparatus for sheet goods, used in conjunction with a T-square, said apparatus comprising: a handle; a clamp, operatively associated with said handle, wherein said clamp is slidably moved along a blade of the T-square when the clamp and associated handle are in an open state and is frictionally locked to the T-square blade when the clamp and associated handle are in a closed state; and a scoring mechanism extending from the handle, said scoring mechanism being suitable for cutting at least a surface of the sheet as the T-square is moved relative to an edge of the sheet.

In accordance with another aspect of the present invention, there is provided a combination scoring and marking apparatus for sheet goods, used in conjunction with a T-square, said apparatus comprising: a handle including a recessed base, wherein the handle is suitable for grasping in the hand of a user; a clamp, operatively associated with said handle, wherein said clamp is slidably moved along a blade of the T-square when the clamp and associated handle are in an open state and is frictionally locked to the T-square blade when the clamp and associated handle are in a closed state, where the clamp may be moved between the open state and the locked state by a user using only one hand; a scoring mechanism associated with and extending from said handle, said scoring mechanism being suitable for cutting at least a surface of the sheet as the T-square is moved relative to an edge of the sheet.; and an adjustable holder for a marking device, connected to said handle, so as to allow the apparatus to mark a sheet as the T-square is moved relative to an edge of the sheet.

In accordance with yet another aspect of the present invention, there is provided a method of using a scoring apparatus for sheet goods, comprising: grasping the apparatus by a handle; sliding a clamp, operatively associated with said handle, over the end of a blade on a T-square; adjusting the apparatus to a desired position along the T-square blade; clamping the apparatus to the T-square blade by rotating the handle relative to the clamp, so that the clamp and is frictionally locked to the T-square blade; placing a head of the T-square adjacent an edge of the sheet goods; extending a scoring mechanism from said handle, said scoring mechanism being suitable for cutting at least a surface of the sheet; and drawing the T-square across the sheet goods so as to create a score thereon.

One aspect of the invention is based on the observation of problems with conventional tools used for the scoring, cutting and marking of sheet goods—difficulty in use and the need for complex fixtures for attachment to conventional T-squares. This aspect is based on the discovery of a technique that alleviates these problems by providing a simple, yet reliable mechanism for the accurate attachment of the tool to a conventional T-square.

This technique can be implemented, for example, by a hinged clamp mechanism that locks the tool to the trunk of a T-square or similar device (e.g., L-square) by a simple rotation of the handle of the tool. On a simple motion a user can lock the tool and begin the scoring of marking of the sheet goods.

A machine implementing the invention can include a device or mechanism for scoring or cutting the sheet (e.g., a retractable knife blade) as well as a device for marking the sheet (e.g., a pencil holder), where the scoring and marking mechanisms are aligned relative to the sheet edge to enable a user to mark and score drywall and similar sheet goods in a consistent and accurate fashion.

The technique described above is advantageous because it is simple and inexpensive compared to other approaches. Furthermore, the device and method of use are adaptable for use with conventional T-squares and other measuring devices so as to make it unnecessary to purchase additional equipment. In addition to its direct application to use with drywall or plasterboard, it can be used to mark and score other types of sheet goods, including ceiling tile, insulation board, paneling, laminates, etc. The techniques of the invention are advantageous because they permit efficient construction of the tool, providing a reliable and accurate method for cutting and marking sheets without incurring the significant expense of an elaborate fixture. As a result of the invention, contractors and do-it-yourselfers will be able to quickly cut and mark sheet goods in a reliable and accurate fashion, thereby reducing wasted effort and materials.

Figure 1:
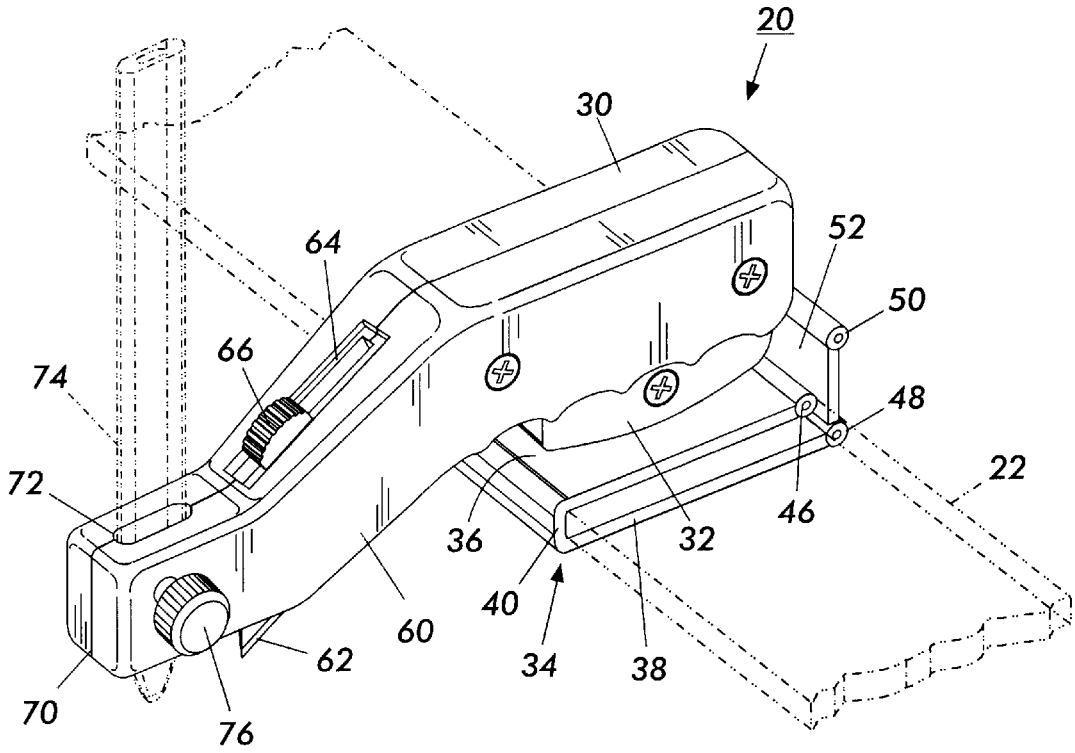
FIG. 1 is a perspective illustration of an embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description. "Drywall" and "plasterboard" are intended to include various types, styles and brands of sheet goods that are composed of a gypsum or similar material sandwiched between layers of a paper/fiber or similar thin substrate, but are also intended to include other sheet goods that would be commonly used in construction and other trades, where the goods may be cut or marked using aspects of the present invention. "Sheet goods" are intended to include construction and similar materials that are sold in standard sizes (e.g., 4'×8', 4'×10', 4'×12') and may include drywall, plywood, particle-board, extruded foam insulation board, paneling, veneers, acoustical board and ceiling tile, etc. The term "T-square" is intended to represent a well-known type of square used in constructions trades for marking and measuring sheet goods, as well as similarly constructed tools, including but not limited to, L-squares and the like.

Turning now to the drawings, FIG. 1 represents a perspective view of an embodiment of the present invention. As previously noted, the drywall tool or apparatus 20 is intended for use with a conventional T-square (22), L-square or similar measuring/alignment tool. FIG. 1 depicts the apparatus 20 in a "closed" position or state, where it is clamped or locked around a blade 22 of a T-square.

Figure 2:
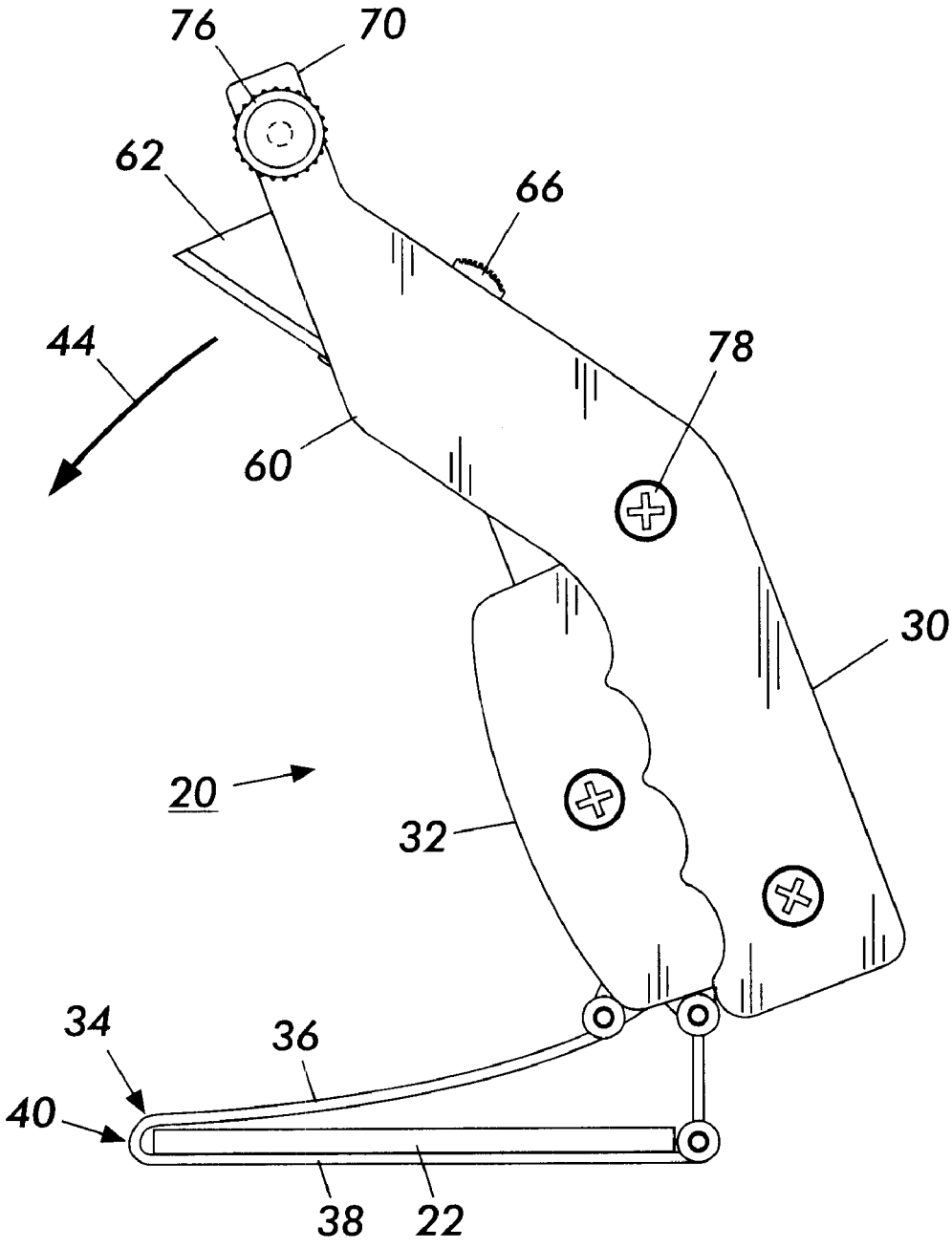
FIG. 2 is a side orthogonal view of the embodiment of FIG. 1 in an "open" position.

FIG. 2 is a side orthogonal view of the embodiment of FIG. 1, however tool 20 is depicted in an "open" position. Referring to FIGS. 1 and 2, tool 20 comprises a handle 30 affixed over a base member 32. Operatively associated with the handle and base is a clamp 34, that includes a top member 36 and a bottom member 38, the top and bottom members being flexibly joined at a nose 40. As depicted in the figures, the clamp may be slidably positioned around the blade 22 of the T-square so as to allow the tool to be positioned at a particular distance from the T-square head (24 in FIG. 5) along the blade. When the handle 30 and base 32 are rotated in the direction of arrow 44, the tool is "closed" and the clamp is tightened against or locked to the blade to prevent movement of the tool relative to the blade. In the locked position, the nose-end and back-end end of clamp member 38 may be slightly raised from the surface of the sheet so as to allow for ease of sliding the tool across a sheet.

Clamp 34 further includes hinge points 46,48,50 and spanning member 52 so as to allow the clamp to be engaged through rotation of the handle, thereby drawing point 50 to a position toward and above point 46. Consequently, the gap between top member 36 and bottom member 38 is eliminated and the members are placed in frictional contact with the T-square blade 22. It will be appreciated that various modifications may be made to the length and other dimensions of members 36 and 38 in order to accommodate different size T-square blades. It is also conceivable that an inner surface of one or both members may be lined with a resilient elastomer or other material that will both cushion the blade as the clamp is slid therethrough and will increase the frictional force applied by the clamp 34 when the toll is in the closed position. It is further conceivable that the tool may be provided with self-adhesive backed pads of such material in varying thicknesses so as to allow the tool to be employed on T-square blades of widely varying thicknesses.

The handle, base and clamp components of the tool 20 may be manufactured from various metal alloys, including light-weight metals such as aluminum and its alloys. The components may also be produced from high-strength plastics that will allow for injection or other molding/fabrication techniques to be employed in the manufacture of the tool. Furthermore, a combination of materials may be employed in the manufacture of the tool, perhaps using metal for the components of clamp 34 and injection-molded plastic for the base and handle elements 32 and 30, respectively. It will be appreciated that the thickness of lower clamp member 38 should be minimized to the extent possible in order to reduce the amount by which the T-square blade is lifted from the surface of the sheet.

Although the size of such a tool may vary according to a particular application, it is believed that the clamp should be approximately 3.0 inches by 2.0 inches, so as to accommodate standard T-square blades. Furthermore, the height of the tool in its closed or locked position should be approximately 2.5 inches so as to keep the center of gravity of the tool close to the blade and sheet. The overall length of the tool, from pencil holder to the hinged side of the base would be between 3.5 and 4.5 inches. Accordingly, the tool may be easily grasped in a user's hand.

Also included as an extension of handle 30 is a retractable knife casing 60 where a conventional utility knife blade 62 may be stored and advanced through an opening at the lower or outer end of the casing. Blade 62 is preferably oriented so that when handle 30 and casing 60 are in a closed position, the blade extending from the casing will contact a sheet to score or cut it. Also included in the casing is a top groove or channel 64 in which a locking adjustment button 66 is located. Mechanism 66 operates in a manner found in many well-known retractable utility knives, where the blade is locked in a position, and is unlocked for adjustment only when the button is depressed and moved. In an alternative embodiment, knife casing may be of a design suitable for the receipt and storage of well-known break-off blades, where the exposed end of the blade is advanced and broken off in order to reveal a sharp edge. Such a blade would require an alternative design and a thumb screw or similar mechanism to control the position of the blade.

As will be appreciated, the present invention may also be implemented with a detachable knife, such that the handle may be implemented so as to incorporate or allow for the insertion of a utility knife (retractable or non-retractable) therein. Such a design would likely incorporate a recessed area for fitting of the utility knife therein, with the knife being retained by a friction fit, a snap/lock fit, or additionally restraining means such as a screw(s), snaps, hook and loop fastener or strap, etc. In yet another alternative embodiment, the retractable knife blade may be held in position by a more simplified mechanism such as a locking set or thumb screw (not shown) so as to eliminate a split-handle design. In such an embodiment, the knife blade 62 would be inserted into a slot in the handle 30, where its position would then be maintained by a set screw.

Further extending from the handle 30, at a position beyond the knife casing is a holder 70 for receiving a pencil 74 or similar marking instrument therein. Holder 70 includes a hole 72 and an adjustable thumb-screw 74 or similar mechanism for holding the pencil in place. As depicted in the figures, the pencil is what is commonly referred to as a carpenter's pencil. Pencil 74 extends through hole 72 where it is contacted by the threaded end (not shown) of thumb-screw 76. Alternatively, hole 72 may be of a size and shape so as to enable the use of other marking instruments.

Figure 3:
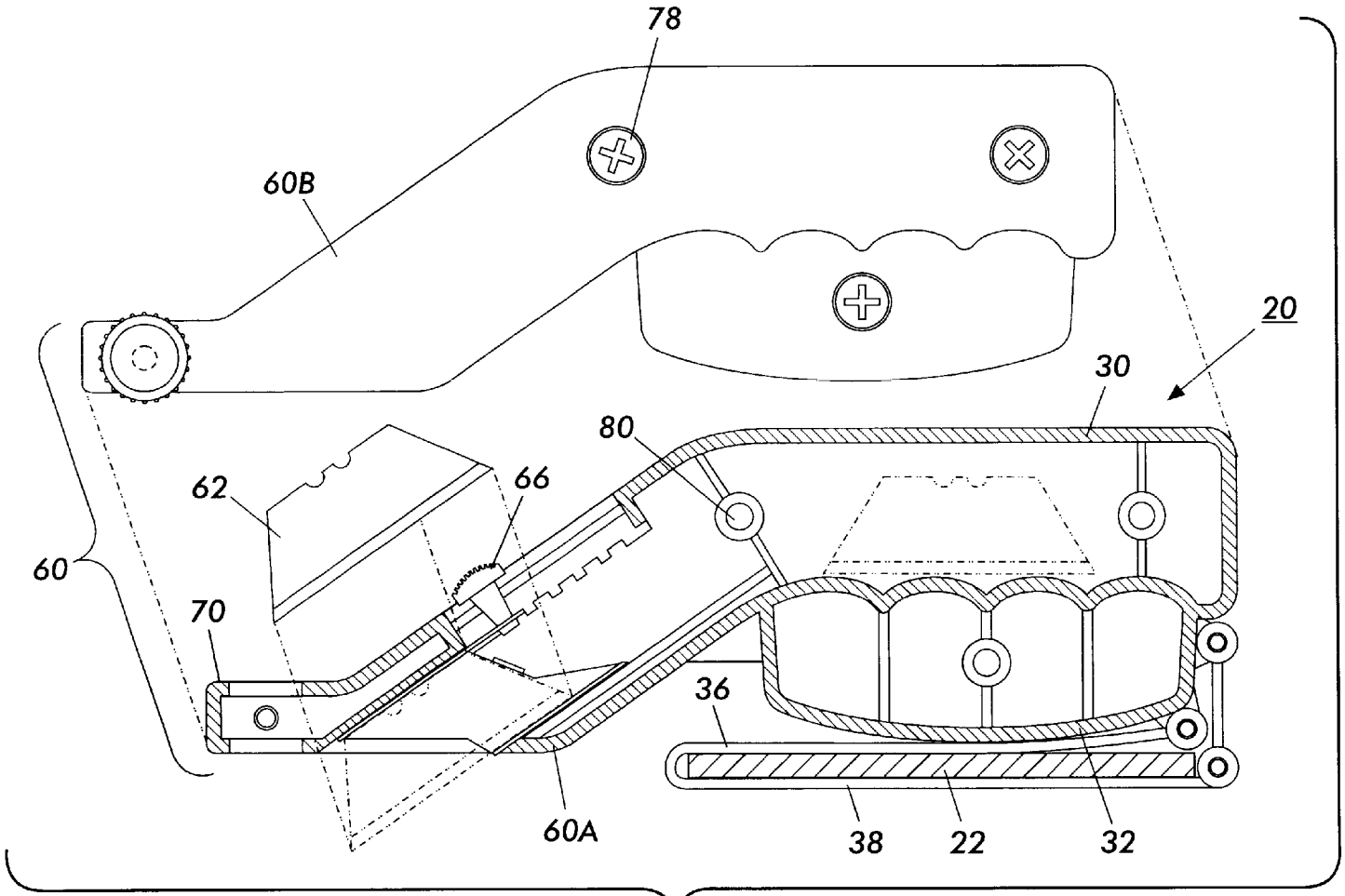
FIG. 3 is a side, assembly view of the embodiment of FIG. 1 in a "closed" position.

Referring next to FIG. 3, there is depicted an assembly view of the embodiment of FIG. 1 in a "closed" position. In the assembly view it is shown that the knife casing 60 is comprised of at least two halves, 60A and 60B. Casing shell 60A is likely integrally formed with handle 30, and casing shell 60B is attached thereto using a machine screw 78 and threaded hole 80 or other fastener suitable for connecting the two halves together without interfering with the extension and retraction of knife blade 62.

Figure 4:
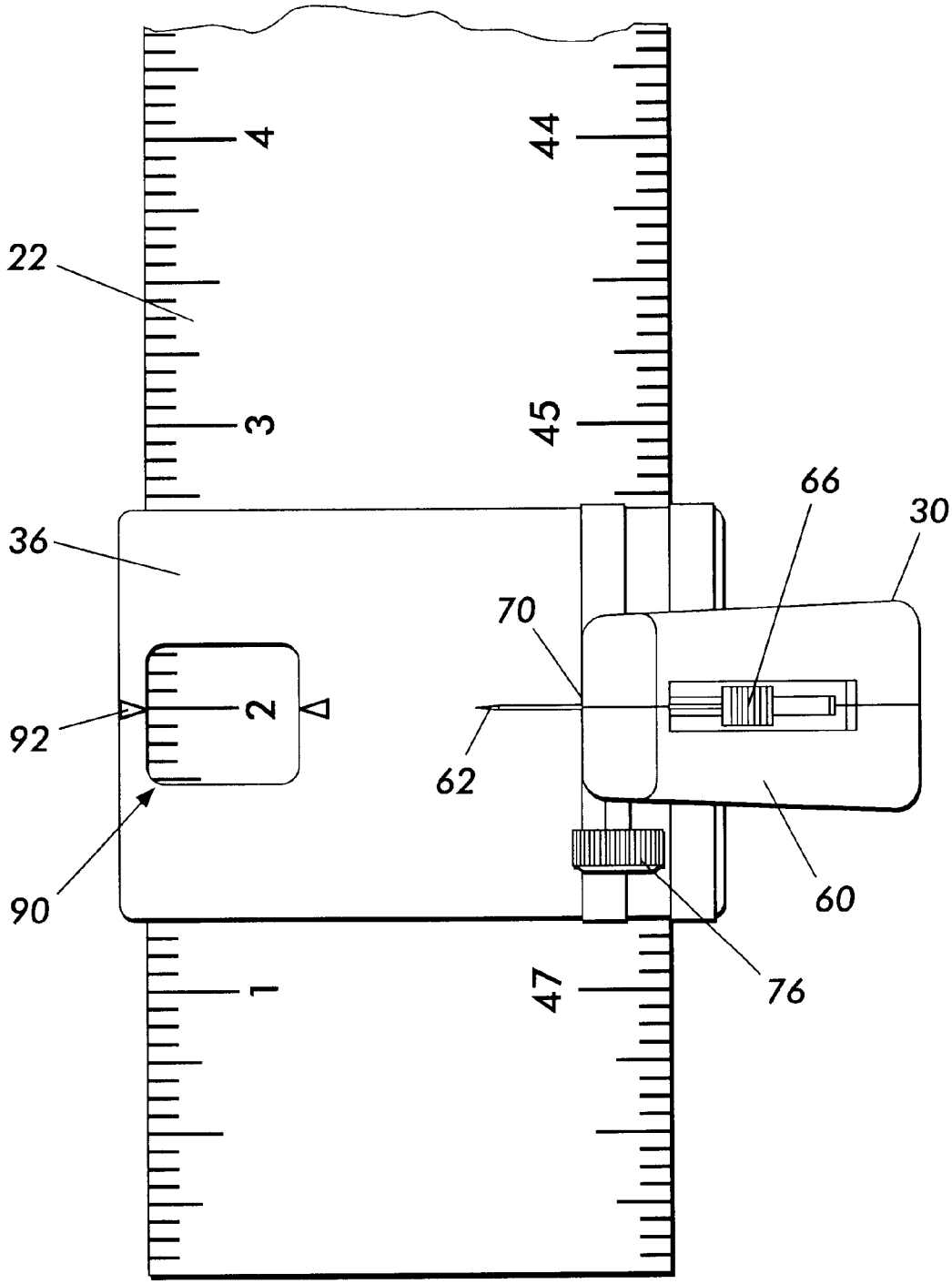
FIG. 4 is a top view of the embodiment of FIG. 1, illustrating the alignment window positioned relative to the T-square.

Considering FIG. 4, which depicts a top view of the embodiment of FIG. 1, it is seen that a window 90 is found extending through top member 36 of the clamp. The window, which may be either a hole, cutout, or a transparent insert in the top member of the clamp, allows the tool 20 to be accurately positioned relative to the T-square blade 22. In particular, window 90 would include a pointer 92 or similar indicia or mark to provide a user with an indication of the tool position. Although depicted on only one end of the top member, it is also conceivable that the window be positioned at a different location or extended for a larger distance across a substantial portion of the width of T-square blade 22. By providing a window that extends substantially across the blade, it may be possible to position the tool using measurements marked on the blade from either direction (head or tip).

Figure 5:
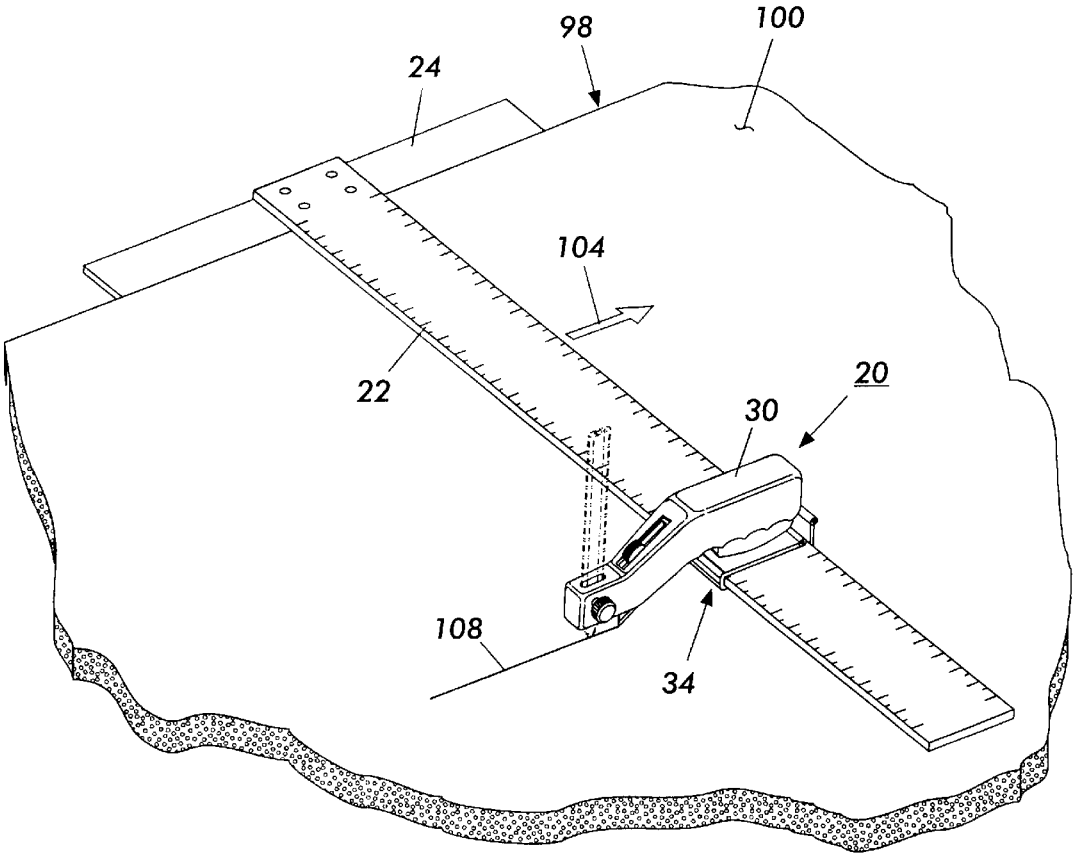
FIG. 5 is a perspective illustration of an embodiment of the present invention in use for scoring a sheet.
Figure 6:
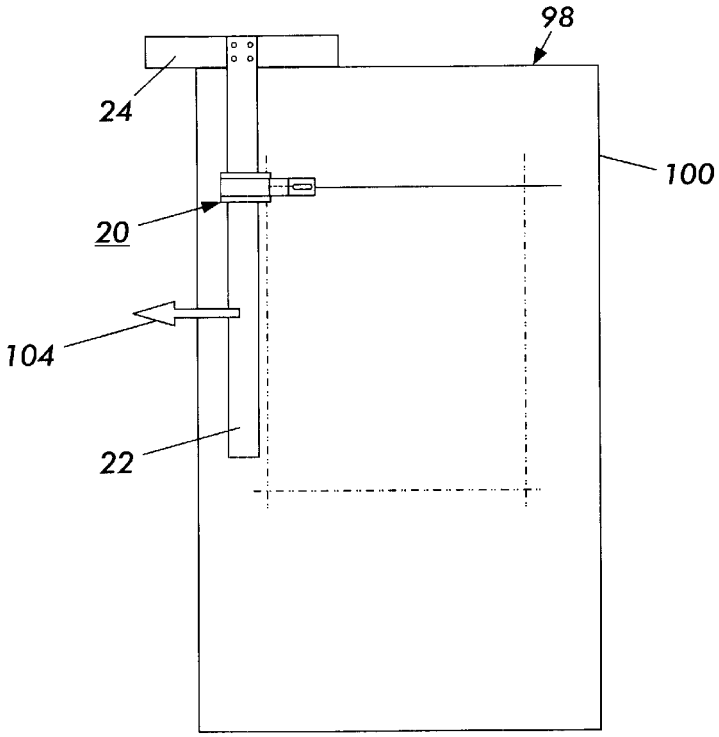
FIGS. 6 and 7 are exemplary representations of the manner in which the present invention may be employed to cut sheet goods.
Figure 7:
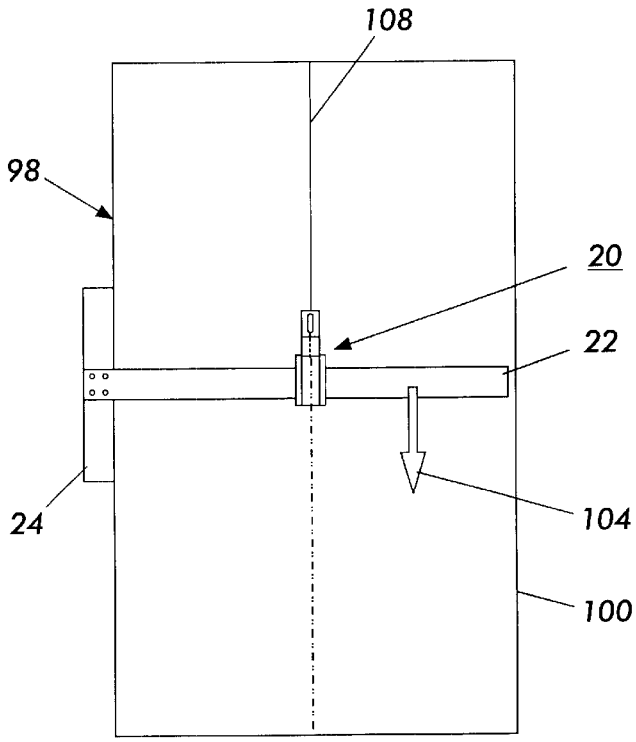

Referring now to FIGS. 5–7 an exemplary use of the present invention will be described. As noted above, one use of the present invention in scoring, cutting and marking a sheet such as drywall. As depicted in the illustrations, the tool 20 is preferably attached to a T-square or similar device via blade 22. The T-square head 24 is then placed along the edge 98 of the sheet 100 from which the cut or mark is to be made. Note that it may also be possible to use the present invention to produce arcs and other cut shapes by anchoring the head of the T-Square on a pivot.

Tool 20 is placed on the blade by sliding the blade through the clamp 34. The tool is then positioned along the blade by aligning the pointer in window 90 (FIG. 4) with a measurement on the blade 22. Once positioned, the handle 30 would be rotated to its closed position, thereby tightening the clamp and placing the knife blade or marking instrument into contact with the surface of the sheet 100. To create the score or cut (or mark if knife is retracted), a user would grasp the handle 30 and the head 24 of the T-square and pull both in the direction indicated by arrow 104. Doing so will cause the knife blade to score or cut the sheet along a cut line indicated by reference numeral 108. In this manner a reliable cut or mark can be made on the sheet goods without a user needing to hold a knife or pencil to the edge of a blade.

As depicted in FIGS. 6 and 7, the cutting or marking techniques enabled by the present invention may be employed to not only score or cut drywall and other sheet goods (FIG. 7), but may also be used to layout and cut holes within a sheet in order to accommodate, for example, windows and electrical boxes. The present invention, therefore, allows for easy use by novice or experienced users. The invention also allows for accurate and reliable cuts or marks to be made on sheet goods.

As an alternative embodiment, the knife blade of the present invention may be replaced with similar cutting mechanisms. For example, were the invention used to score a large sheet of glass or plastic glazing, the knife blade could be replaced with an industrial diamond tip or similar glass scoring element in order to "scratch" the surface of the glazing sheet. Similarly, in the event that the invention is employed in the cutting of plastic or elastomeric sheet goods, it may be possible to replace the knife blade with an electrical heating element that will melt/cut thin plastic sheets.

As another alternative, the pencil of the present invention, employed to produce a mark on drywall, may be replaced by equivalent marking instruments such as pens, markers, wax and construction crayons, and other marking devices suitable for marking the particular type of sheet goods.

In recapitulation, the present invention is a method and apparatus for scoring and marking sheet goods, particularly drywall or plasterboard. The apparatus is used in conjunction with a conventional T-square and consists of a clamp for locking the apparatus at a fixed position along the T-square and a scoring mechanism such as a utility-knife blade for scoring the sheet as the T-square slides along a straight edge thereof. The apparatus further includes a marking mechanism, aligned with the scoring mechanism so as to allow a user to optionally mark the sheet rather than scoring it.

It is, therefore, apparent that there has been provided, in accordance with the present invention, a method and apparatus for scoring and marking sheet goods, including drywall. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A scoring apparatus for sheet goods, used in conjunction with a T-square, said apparatus comprising:

a handle;

a clamp, operatively associated with said handle, wherein said clamp is slidably moved along a blade of the T-square when the clamp and associated handle are in an open state and is frictionally locked to the T-square blade when the clamp and associated handle are in a closed state; and wherein said clamp further comprises a top member connected to said handle at a first position;

a bottom member, where the top and bottom members are joined at a nose;

and a back member, operatively coupling the bottom member to the handle at a second position spaced apart from the first position, such that rotation of the handle relative to the top clamp member causes at least the top member and bottom member to be drawn toward one another and to frictionally engage the T-square blade; and a scoring mechanism extending from the handle, said scoring mechanism being suitable for cutting at least a surface of the sheet as the T-square is moved relative to an edge of the sheet.

2. The apparatus of claim 1, wherein said handle further comprises a knife casing, said knife casing holding a retractable knife blade therein, and where said scoring mechanism is the retractable knife blade when the blade is extended so that at least a tip of said blade protrudes from said knife casing.

3. The apparatus of claim 1, further comprising an adjustable holder for a marking device, connected to said handle, so as to allow the apparatus to mark a sheet as the T-square is moved relative to an edge of the sheet, wherein said marking device and said scoring mechanism are in alignment with one another relative to the edge of the sheet.

4. The apparatus of claim 3, wherein said adjustable holder comprises a locking mechanism for releasably locking the marking device within the adjustable holder.

5. The apparatus of claim 4, wherein said marking device is a pencil.

6. The apparatus of claim 1, wherein said bottom clamp member presents a rounded profile at the surface of the sheet so as to enable the apparatus to be slidably drawn across a sheet.

7. The apparatus of claim 1, wherein said clamp includes a window therein so as to allow alignment of said scoring mechanism with a marking on the T-square blade.

8. The apparatus of claim 2, wherein said handle is of a split design so as to allow access to an interior region thereof for the replacement of retractable knife blade and the storage of replacement blades therein.

9. A combination scoring and marking apparatus for sheet goods, used in conjunction with a T-square, said apparatus comprising:

a handle including a recessed base, wherein the handle is suitable for grasping in the hand of a user;

a clamp, operatively associated with said handle, wherein said clamp is slidably moved along a blade of the T-square when the clamp and associated handle are in an open state and is frictionally locked to the T-square blade when the clamp and associated handle are in a closed state, where the clamp may be moved between the open state and the locked state by a user using only one hand;

and wherein said clamp further comprises a top member connected to said handle at a first position;

a bottom member, where the top and bottom members are joined at a nose; and a back member, operatively coupling the bottom member to the handle at a second position spaced apart from the first position, such that rotation of the handle relative to the top clamp member causes at least the top member and bottom member to be drawn toward one another and to frictionally engage the T-square blade;

a scoring mechanism associated with and extending from said handle, said scoring mechanism being suitable for cutting at least a surface of the sheet as the T-square is moved relative to an edge of the sheet; and an adjustable holder for a marking device, connected to said handle, so as to allow the apparatus to mark a sheet as the T-square is moved relative to an edge of the sheet.

10. The apparatus of claim 9, wherein said adjustable holder comprises a locking mechanism for releasably locking the marking device within the adjustable holder.

11. The apparatus of claim 10, wherein said marking device is a pencil.

12. The apparatus of claim 9, wherein said bottom clamp member presents a rounded profile at the surface of the sheet so as to enable the apparatus to be slidably drawn across a sheet.

13. The apparatus of claim 9, wherein said clamp includes a window therein so as to allow alignment of said scoring mechanism with a marking on the T-square blade.

14. The apparatus of claim 9, wherein said handle is of a split design so as to allow access to an interior region thereof for the replacement of retractable knife blade and the storage of replacement blades therein.

15. A method of using a scoring apparatus for sheet goods, comprising:

grasping the apparatus by a handle;

sliding a clamp, operatively associated with said handle, over the end of a blade on a T-square;

adjusting the apparatus to a desired position along the T-square blade;

clamping the apparatus to the T-square blade by rotating the handle relative to the clamp, so that the clamp is frictionally locked to the T-square blade;

placing a head of the T-square adjacent an edge of the sheet goods;

extending a scoring mechanism from said handle, said scoring mechanism being suitable for cutting at least a surface of the sheet; and drawing th e T-square across the sheet goods s o as to create a score thereon.

16. The method of claim 15, wherein the clamp comprises a top member connected to the handle at a first position, a bottom member, where the top and bottom members are joined at a nose, and a back member, operatively coupling the bottom member to the handle at a second position spaced apart from the first position; and where said step of clamping the apparatus to the T-square blade rotating the handle relative to the clamp further comprises rotation of the handle relative to the top clamp member, thereby causing at least the top member and bottom member to be drawn toward one another and to frictionally engage the T-square blade therebetween.

* * * * *